US010279240B2

(12) United States Patent
Smith

(10) Patent No.: US 10,279,240 B2
(45) Date of Patent: May 7, 2019

(54) INTERFACE FOR ENABLING A SPLITBOARD BINDING TO BE MOUNTED TO ANY SNOWBOARD

(71) Applicant: Dallas Smith, Taylorsville, UT (US)

(72) Inventor: Dallas Smith, Taylorsville, UT (US)

( * ) Notice: Subject to any disclaimer, the term of this patent is extended or adjusted under 35 U.S.C. 154(b) by 0 days.

(21) Appl. No.: 16/052,292

(22) Filed: Aug. 1, 2018

(65) Prior Publication Data

US 2019/0038958 A1 Feb. 7, 2019

Related U.S. Application Data

(60) Provisional application No. 62/542,165, filed on Aug. 7, 2017.

(51) Int. Cl.
*A63C 10/14* (2012.01)
*A63C 10/18* (2012.01)

(52) U.S. Cl.
CPC ..... *A63C 10/14* (2013.01); *A63C 10/18* (2013.01)

(58) Field of Classification Search
CPC ..... A63C 10/14; A63C 10/16; A63C 10/18
USPC ..... 280/607, 613
See application file for complete search history.

(56) References Cited

U.S. PATENT DOCUMENTS 5,820,155 A * 10/1998 Brisco ..... A63C 10/12 280/607
5,984,324 A * 11/1999 Wariakois ..... A63C 5/02 280/14.24
6,557,866 B2 * 5/2003 Jones ..... A63C 10/10 280/14.22
6,655,700 B1 * 12/2003 Caputo ..... A63C 10/10 280/11.3

* cited by examiner

*Primary Examiner* — John D Walters
(74) *Attorney, Agent, or Firm* — Kirton McConkie; Brian Tucker

(57) ABSTRACT

An interface for enabling a splitboard binding to be mounted to any snowboard is provided. The interface includes a baseplate that includes a disc for mounting the baseplate to a snowboard. The disc is configured to correspond with a common snowboard binding hole pattern to thereby allow the baseplate to be mounted on most snowboards. The interface further includes a puck that is configured to mount to the top surface of the baseplate. The puck is configured to interlock with many types of splitboard bindings. In this way, splitboard bindings can be mounted to a snowboard.

20 Claims, 12 Drawing Sheets

INTERFACE FOR ENABLING A SPLITBOARD BINDING TO BE MOUNTED TO ANY SNOWBOARD

CROSS-REFERENCE TO RELATED APPLICATIONS

This application claims priority to U.S. Provisional Patent Application No. 62/542,165 which was filed on Aug. 7, 2017.

BACKGROUND

A splitboard is a snowboard that splits into two halves. These halves can then be worn similar to cross-country skis (commonly referred to as "touring mode") to thereby allow the snowboarder to ascend the mountain. After ascending to a desired location, the snowboarder can combine the halves to form a snowboard (commonly referred to as "riding mode") for descending the mountain.

Interfaces have been developed to allow a "splitboard binding" to be mounted to the splitboard in both touring and riding modes. For touring mode, each half of the splitboard includes a touring bracket to which the front of the splitboard binding is coupled in a pivoting manner. Each splitboard half or the splitboard binding may also include a climbing bar (or heel riser, rest or lock) to provide support when climbing steeper terrain (i.e., when the heel is lifted substantially above the splitboard). For riding mode, two pairs of "pucks" or other structures are mounted on the splitboard so that the splitboard bindings can be coupled across the two halves. Typically, these pucks are configured to allow a slider plate or base plate of the splitboard binding to slide overtop and/or interlock with the pucks. In short, these interfaces allow the splitboard bindings to be quickly and easily moved between the touring and riding modes.

BRIEF SUMMARY

The present invention extends to an interface for enabling a splitboard binding to be mounted to any snowboard. The interface includes a baseplate that includes a disc for mounting the baseplate to a snowboard. The disc is configured to correspond with the common snowboard binding hole patterns to thereby allow the baseplate to be mounted on most snowboards. The interface further includes a puck that is configured to mount to the top surface of the baseplate. The puck is configured to interlock with many types of splitboard bindings. In this way, splitboard bindings can be mounted to a snowboard.

In some cases, the baseplate can include a hole pattern that matches a bolt pattern of a traditional splitboard to thereby allow other providers' pucks/adapters to be coupled to the baseplate. In this way, the present invention can enable many types of splitboard bindings to be mounted to a traditional snowboard.

In some embodiments, the present invention is implemented as an interface for enabling a splitboard binding to be mounted to a snowboard. The interface includes: a baseplate having an opening; a disc configured to insert into the opening in the baseplate, the disc including holes by which the disc can be mounted to a snowboard via a binding hole pattern of the snowboard, the disc being configured to secure the baseplate to the snowboard when the disc is mounted to the snowboard; and a puck that is configured to mount to the baseplate, the puck being configured to receive and secure a splitboard binding.

In other embodiments, the present invention is implemented as an interface for enabling a splitboard binding to be mounted to a snowboard. The interface includes: a baseplate having an opening, the opening including a notched inward facing surface; a disc having a notched outward facing surface that interfaces with the notched inward facing surface, the disc including holes by which the disc can be mounted to a snowboard via a binding hole pattern of the snowboard; and a puck that is configured to mount to the baseplate, the puck being configured to receive and secure a splitboard binding.

In other embodiments, the present invention is implemented as an interface for enabling a splitboard binding to be mounted to a snowboard. The interface includes: a baseplate having an opening, the opening including an inward facing surface; a disc having an outward facing surface that interfaces with the inward facing surface to secure the baseplate to a snowboard when the disc is secured to the snowboard; and a puck that is configured to mount to the baseplate, the puck being configured to receive and secure a splitboard binding.

This summary is provided to introduce a selection of concepts in a simplified form that are further described below in the Detailed Description. This Summary is not intended to identify key features or essential features of the claimed subject matter.

BRIEF DESCRIPTION OF THE DRAWINGS

Understanding that these drawings depict only typical embodiments of the invention and are not therefore to be considered limiting of its scope, the invention will be described and explained with additional specificity and detail through the use of the accompanying drawings in which.

DETAILED DESCRIPTION

As introduced in the background, unlike a traditional snowboard binding, a splitboard binding is configured to selectively mount to a splitboard in either the touring or riding mode. Accordingly, to use a splitboard, a snowboarder will not only need to invest in the splitboard itself, but will also need to invest in these specialized splitboard bindings. However, many snowboarders that use a splitboard, or at least those that use splitboard bindings, may still desire to ride their traditional snowboards. The present invention provides a way for snowboarders to use their splitboard bindings on their traditional snowboards.

Figure 5A:
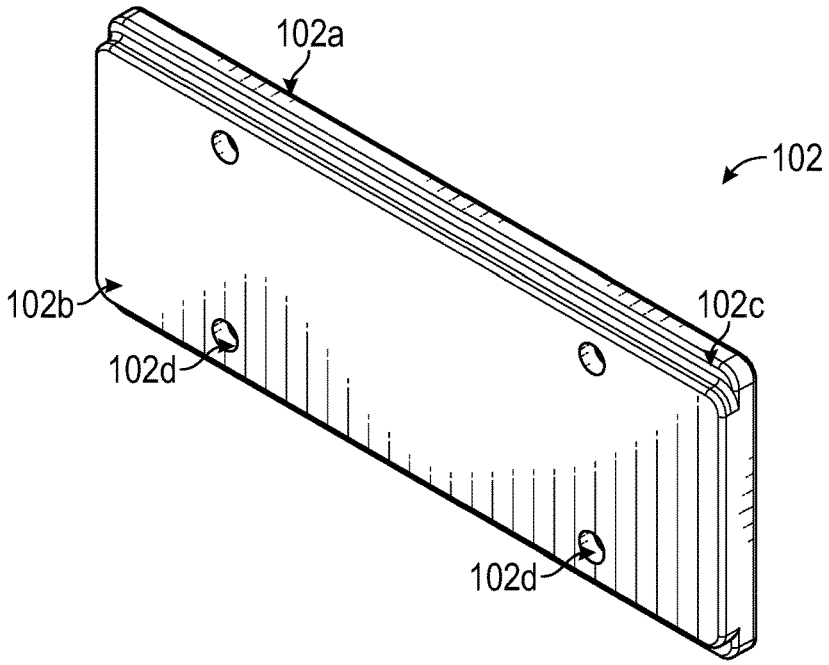
FIG. 5A illustrates a bottom perspective view of a puck of the interface of FIGS. 1A-1E.
Figure 5B:
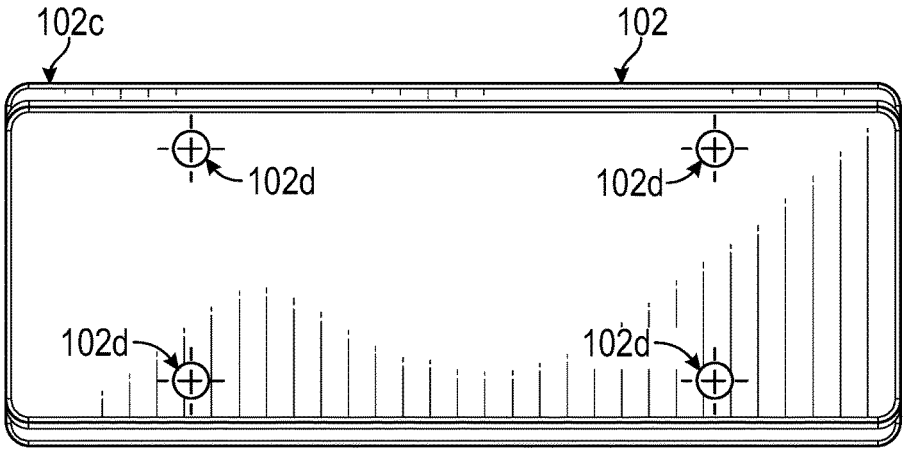
FIG. 5B illustrates a bottom view of the puck.
Figure 5C:
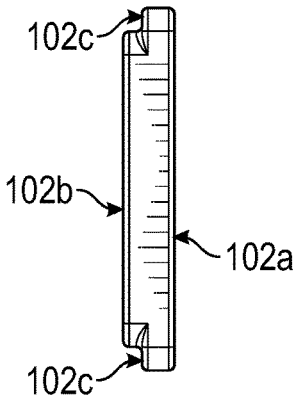
FIG. 5C illustrates a side view of the puck.

FIGS. 1A-1E illustrate various views of an interface 100 for enabling a splitboard binding to be mounted to any snowboard. Interface 100 includes a baseplate 101, a puck 102 that is configured to mount to baseplate 101 via T-nuts 104 (or another suitable coupler) and bolts (not shown), and a disc 103 that is configured to be inserted into an opening in baseplate 101 and by which interface 100 is mounted to the snowboard. FIGS. 2A and 2B illustrate baseplate 101 in isolation, while FIG. 2C illustrates another embodiment of a baseplate 201. FIGS. 3A-3C and 4A-4C illustrate a disc 103 with different hole patterns. FIGS. 5A-5C illustrate puck 102 in isolation.

As shown, baseplate 101 is rectangular in shape (although other shapes could be used) and includes a central opening 101*a* for receiving disc 103. The inward facing surface 101*a*1 of opening 101*a* is notched to correspond with notches in the outward facing surface 103*a* of disc 103. The circular shape of disc 103 and opening 101*a* allow disc 103 to be inserted at any rotational position while the corresponding notches prevent baseplate 101 from rotating relative to disc 103 once disc 103 is inserted into opening 101*a* and mounted to the snowboard.

Disc 103 includes a number of holes 103*b* that are arranged in patterns that correspond with the various binding hole patterns commonly used on snowboards (e.g., 4×4, 2×4, 3D, Burton Channel, etc). Accordingly, by selecting a disc 103 with the appropriate hole pattern, interface 100 can be mounted to virtually any modern snowboard. Additionally, to allow interface 100 to be used on a vintage snowboard that employs the "5-bolt" hole pattern, each end of baseplate 101 can include arched arrangements of mounting holes 101*c* (such as is shown in FIGS. 2A and 2B) or arched slots 201*c* (such as is shown in FIG. 2C). Bolts can be inserted through mounting holes 101*c* or arched slots 201*c* into the outer four holes of the 5-bolt hole pattern while a bolt can be inserted through a hole 103*b* in disc 103 and into the center hole of the 5-bolt hole pattern.

In FIGS. 2A and 2B, there are three arched arrangements of mounting holes 101*c* at each end while in FIG. 2C, there are three arched slots 201*c* at each end. In either case, the spacing of the arched arrangements/slots allows baseplate 101 to be mounted to a snowboard with the vintage 5-bolt hole pattern in multiple positions so that the toe will be spaced a desirable distance from the edge of the snowboard. Likewise, the arched arrangements/slots allow baseplate 101 to be rotated so that the foot will be positioned at a desired angle.

Figure 7:
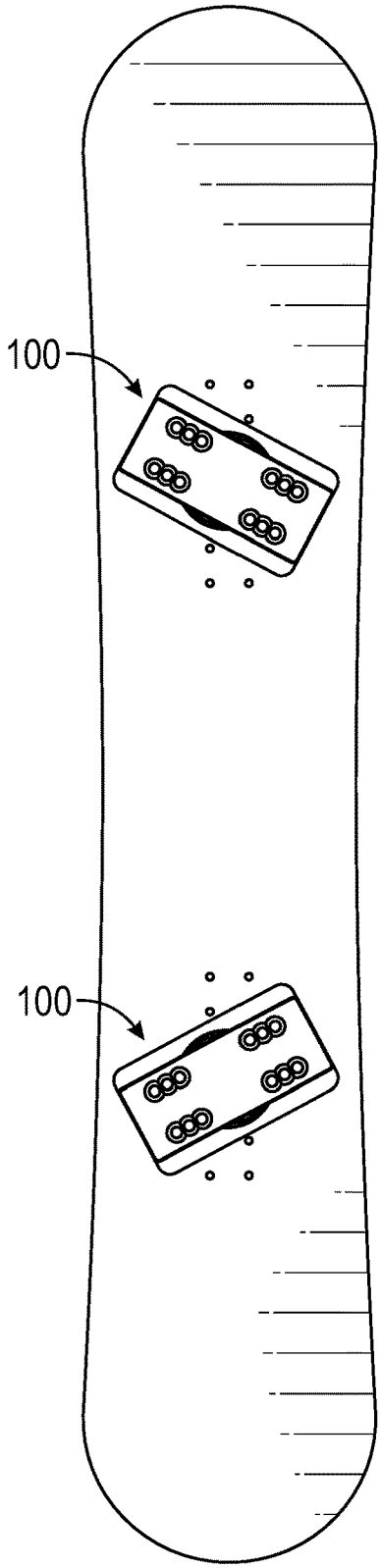
FIG. 7 illustrates an example of how the interface of the present invention can be mounted to a traditional snowboard.

Surface 101*a*1 of opening 101*a* is angled outwardly while surface 103*a* of disc 103 is angled inwardly such that baseplate 101 will be secured to the top surface of the snowboard once disc 103 is mounted. More specifically, as couplers (such as bolts) that extend through holes 103*b* are tightened into the holes of a snowboard, surface 103*a* will apply a downward force against surface 101*a*1 thereby sandwiching baseplate 101 between the snowboard and disc 103. Prior to tightening disc 103 within opening 101*a*, baseplate 101 can be rotated to a desired orientation relative to the snowboard so that the snowboarder's feet will be properly angled such as is shown in FIG. 7.

Puck 102 includes a top surface 102*a*, a bottom surface 102*b*, and opposing ledges 102*c* that extend lengthwise along puck 102. In some embodiments, such as is shown in FIG. 5C, top surface 102*a* can be wider than bottom surface 102*b* thereby causing ledges 102*c* to be formed along the underside of top surface 102*a*. However, ledges 102*c* could be formed in another manner. Puck 102 can include holes 102*d* that extend through top and bottom surfaces 102*a*/102*b* and that align with corresponding holes 101*b* in baseplate 101 (e.g., forming four corners of a rectangular shape).

Figure 1A:
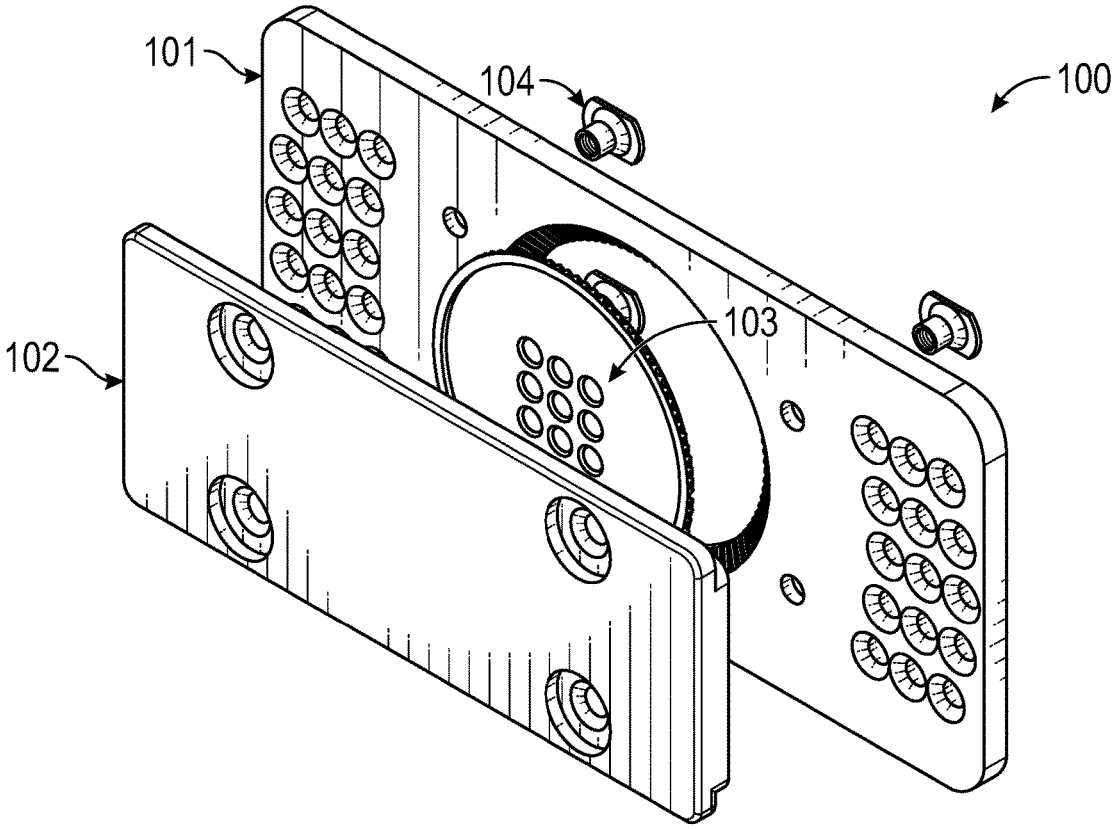
FIG. 1A illustrates a top perspective exploded view of an interface for enabling a splitboard binding to be mounted to any snowboard in accordance with one or more embodiments of the present invention.
Figure 1B:
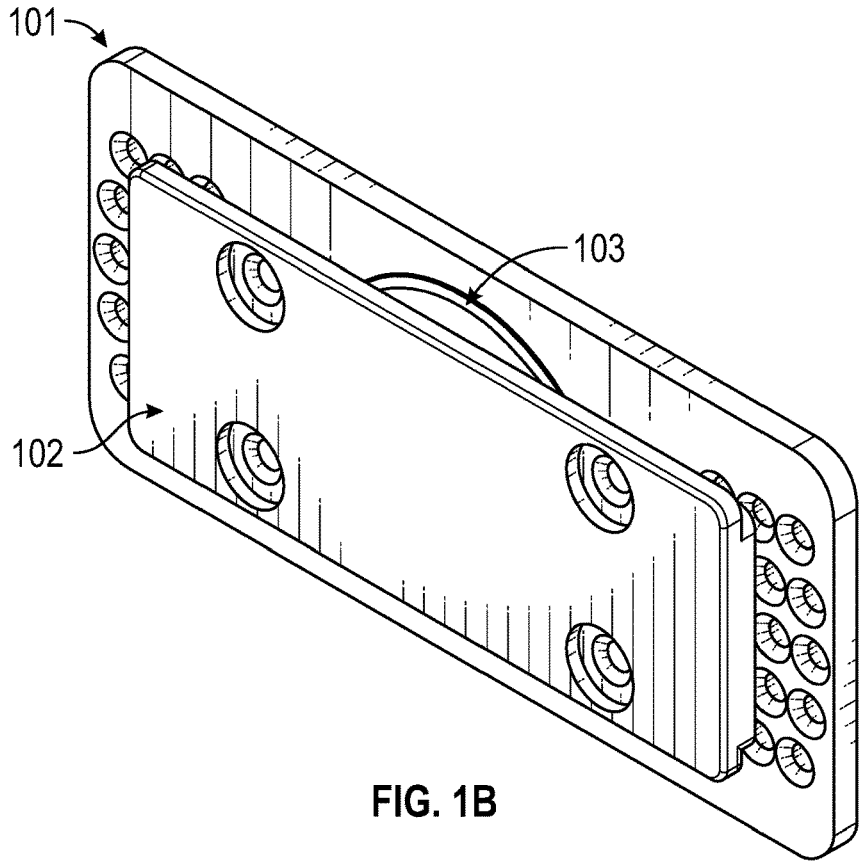
FIG. 1B illustrates a top perspective view of the interface of FIG. 1A.
Figure 1C:
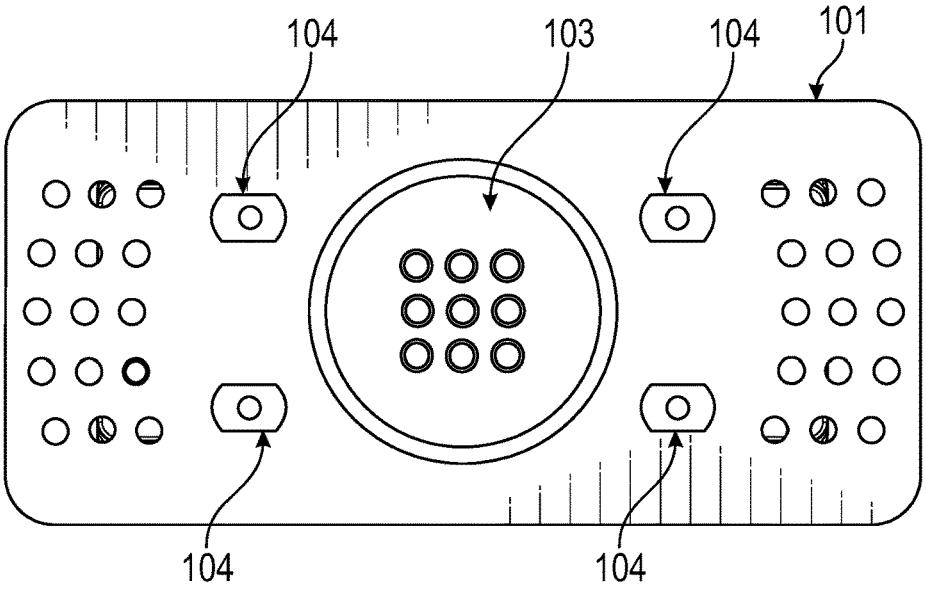
FIG. 1C illustrates a bottom view of the interface of FIG. 1A.
Figure 1D:
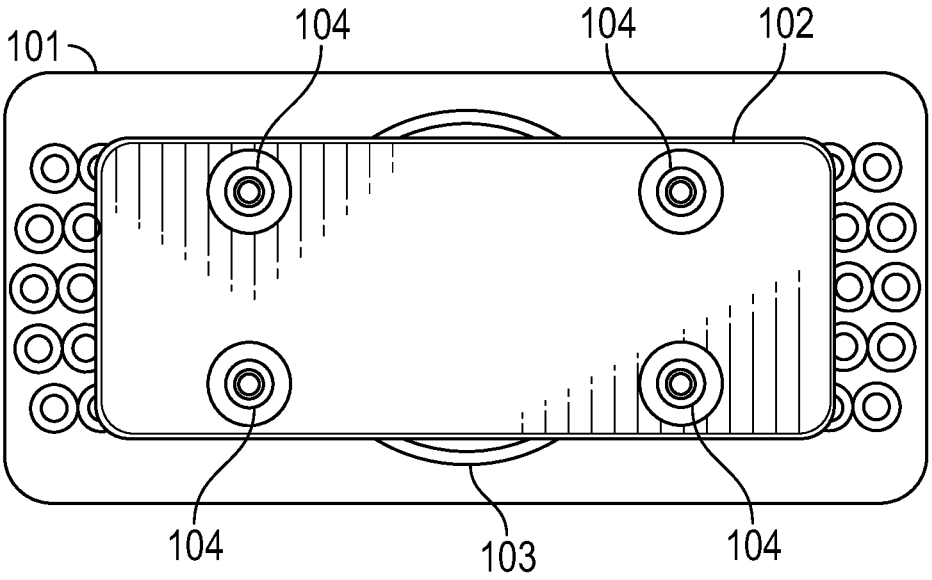
FIG. 1D illustrates a top view of the interface of FIG. 1A.
Figure 1E:
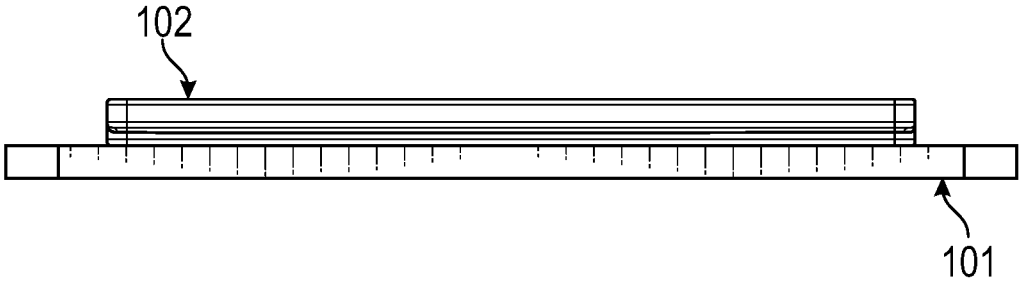
FIG. 1E illustrates a side view of the interface of FIG. 1A.
Figure 2A:
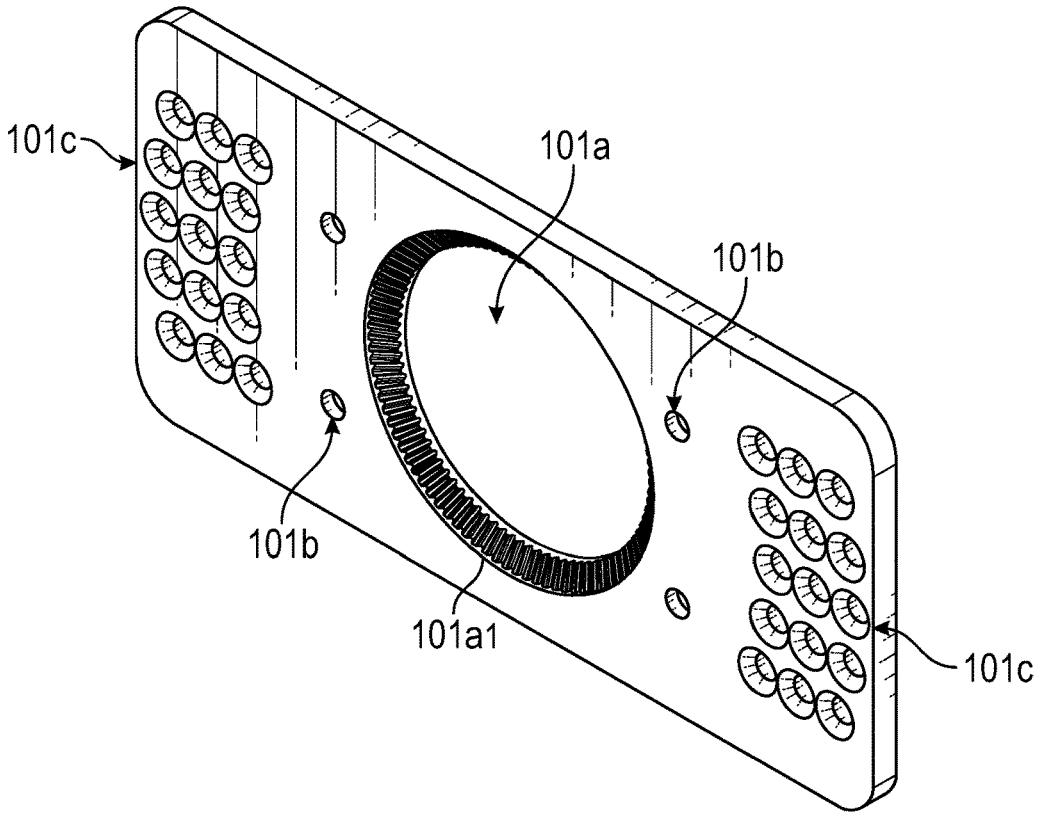
FIG. 2A illustrates a top perspective view of a baseplate of the interface of FIGS. 1A-1E.
Figure 2B:
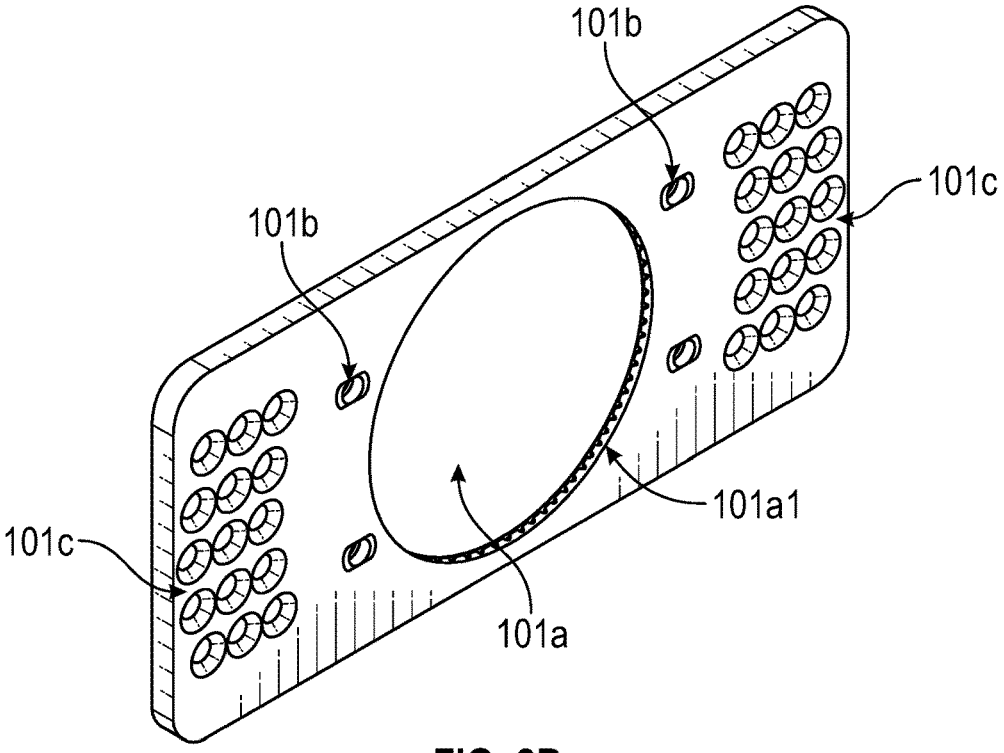
FIG. 2B illustrates a bottom perspective view of the baseplate.
Figure 2C:
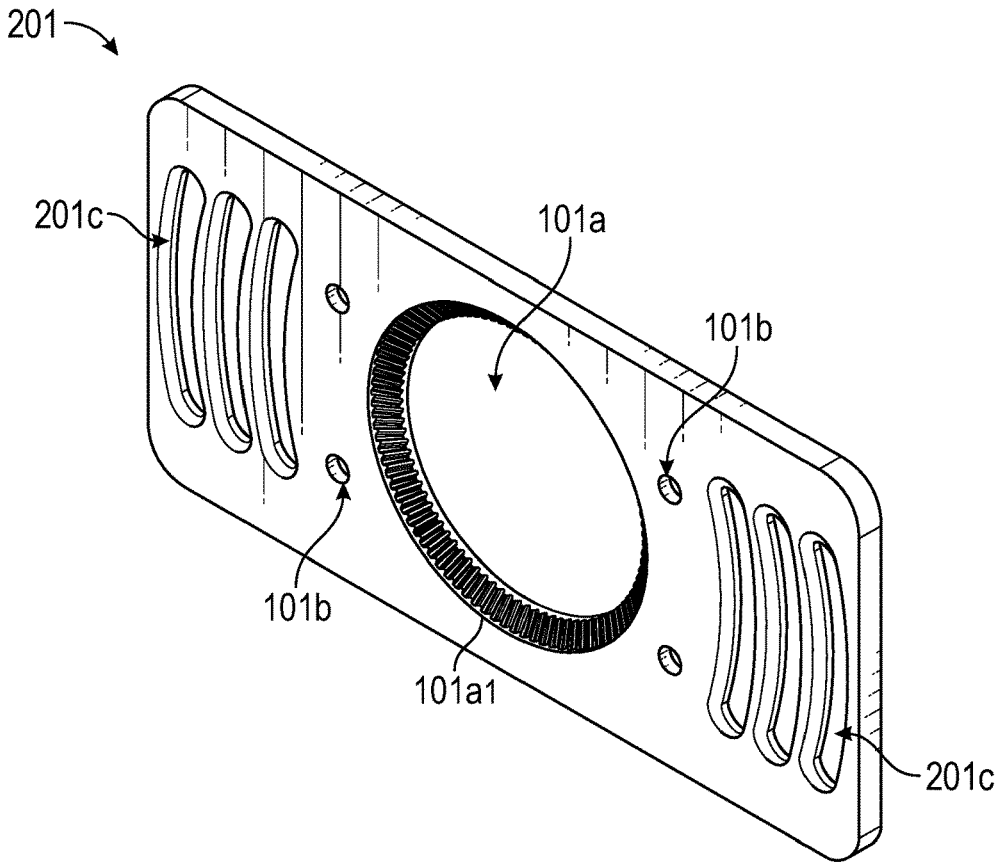
FIG. 2C illustrates a top perspective view of another baseplate that can be used with the interface of the present invention.
Figure 3A:
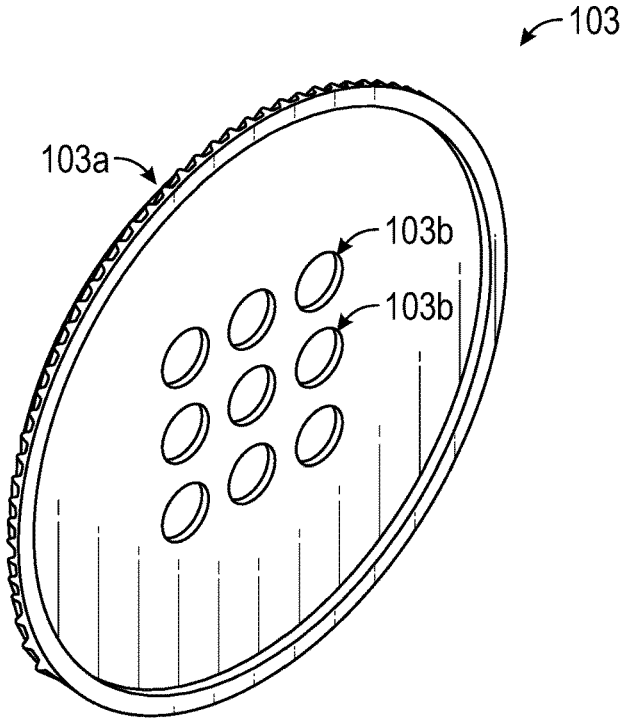
FIG. 3A illustrates a top perspective view of a disc of the interface of the present invention.
Figure 3B:
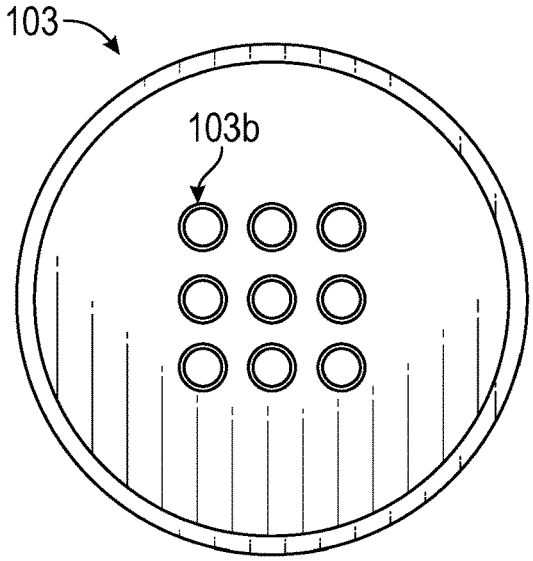
FIG. 3B illustrates a top view of the disc.
Figure 3C:
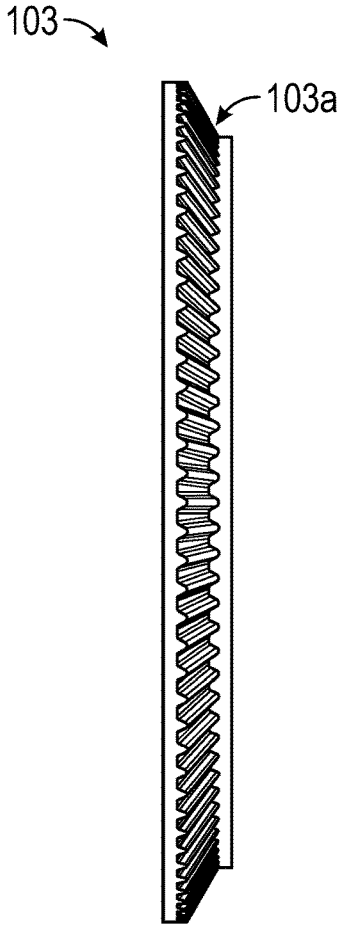
FIG. 3C illustrates a side view of the disc.
Figure 4A:
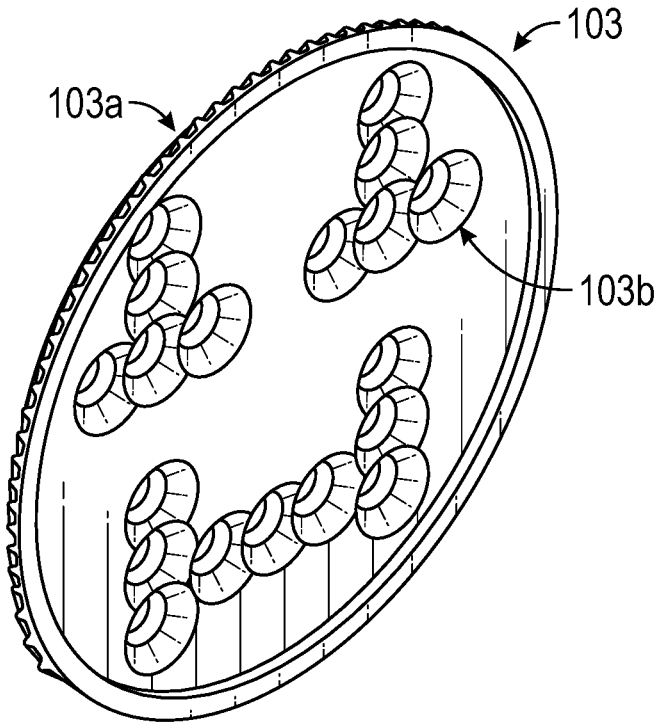
FIG. 4A illustrates a top perspective view of another disc that can be used with the interface of the present invention.
Figure 4B:
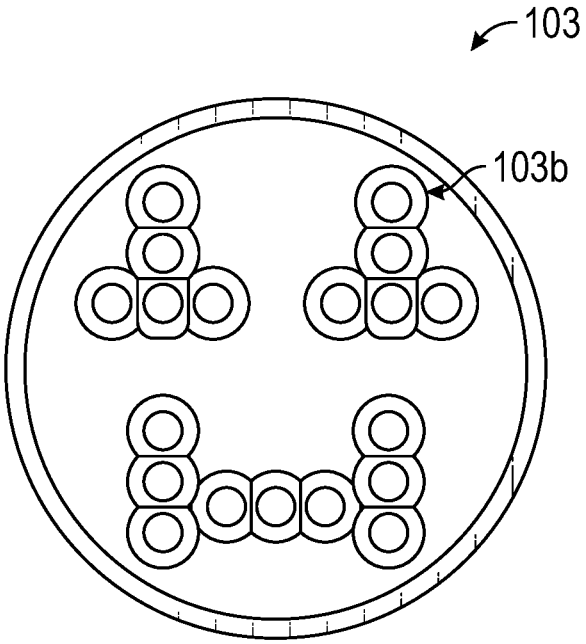
FIG. 4B illustrates a top view of the disc.
Figure 4C:
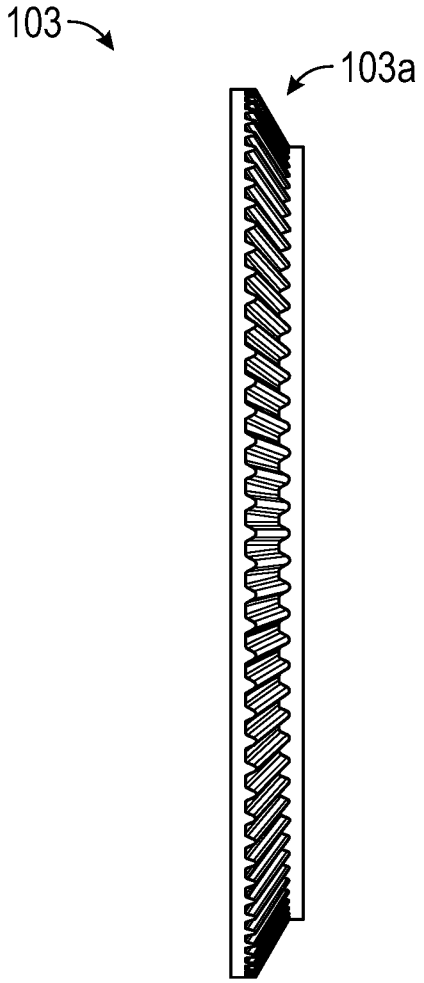
FIG. 4C illustrates a side view of the disc.

Referring to FIG. 1A, T-nuts 104 (or another suitable coupler) can be positioned underneath baseplate 101 to extend through holes 101*b* when baseplate 101 is secured to the snowboard. Then, bolts (or another type of fastener) can be inserted through holes 102*d* in puck 102 to engage with t-nuts 104 to thereby mount puck 102 to baseplate 101 with top surface 102*a* facing upward away from the snowboard. Ledges 102*c* will therefore face downward towards the snowboard. The dimensions of ledges 102*c* can be configured to match the dimensions of the slider track or base plate of a splitboard binding so that the splitboard binding can be coupled to puck 102. This will allow the splitboard binding to be used on a snowboard. For example, if the snowboarder has Voile splitboard bindings, the Voile Slider Track can slide overtop puck 102 to interlock underneath ledges 102*c*.

In some embodiments, holes 101*b* can be configured to align with a bolt pattern of a traditional splitboard (i.e., in a 3.5 inch by 1 inch pattern). In such embodiments, other providers' pucks/adapters (which have a 3.5 inch by 1 inch bolt hole pattern) can be coupled to baseplate 101/201 in place of puck 102. In this way, baseplate 101/201 can be used to mount the other providers' pucks/adapters to a traditional snowboard.

Figure 6A:
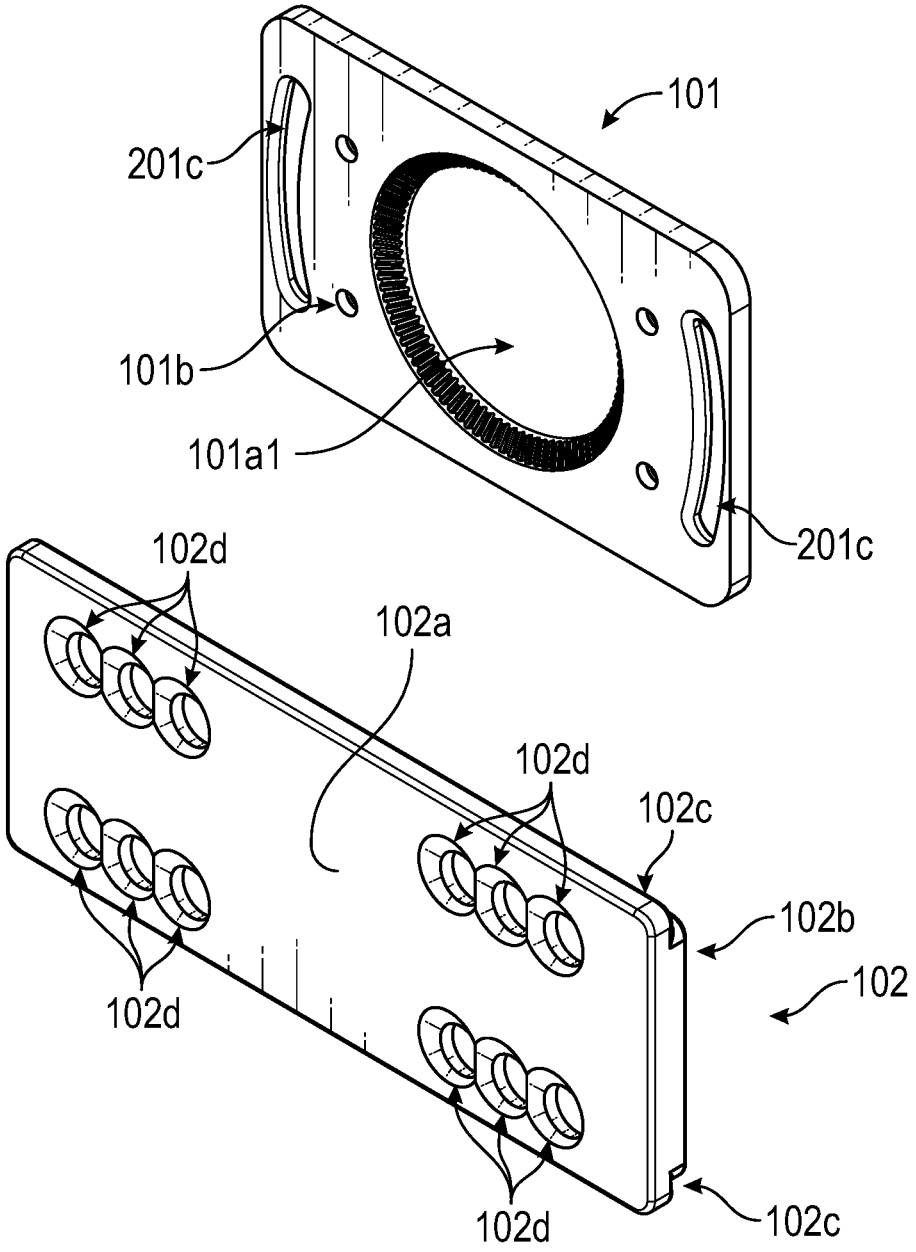
FIG. 6A illustrates top perspective views of additional embodiments of a baseplate and a puck that can be used with the interface of the present invention.
Figure 6B:
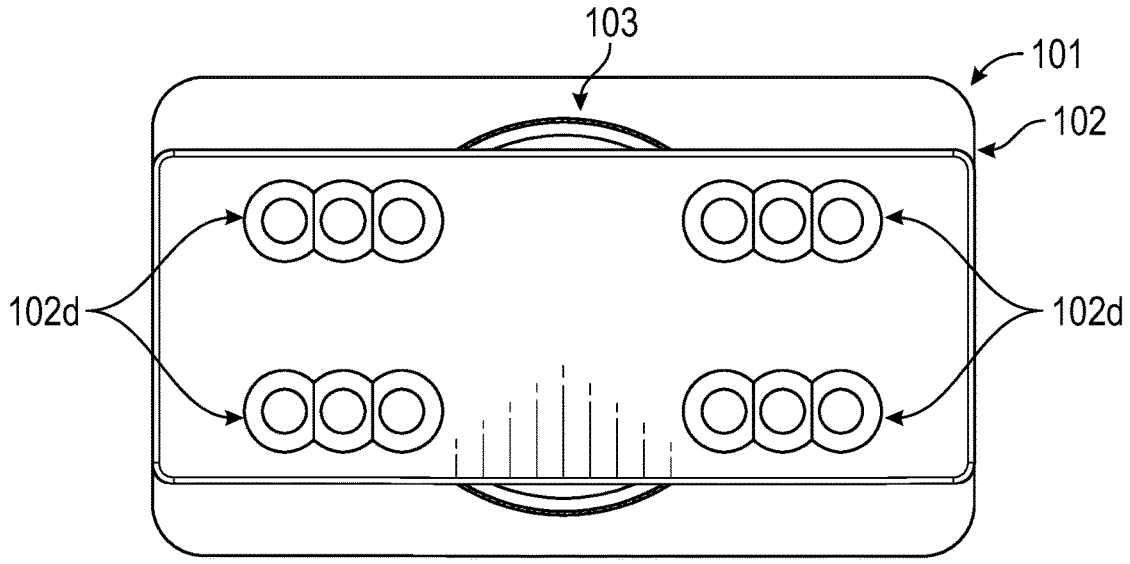
FIG. 6B illustrates a top view of the baseplate and puck of FIG. 6A.

As shown in FIGS. 6A and 6B, in some embodiments, puck 102 may include arrays of holes 102*d* that allow puck 102 to be coupled to baseplate 101 in a number of relative positions. For example, in FIGS. 6A and 6B, each array includes three holes 102*d*. When the center hole in each array is aligned with holes 101*b*, puck 102 will align with baseplate 101. In contrast when the leading or trailing hole in each array is aligned with holes 101*b*, puck 102 will be offset relative to baseplate 101 towards the toe or heel respectively. Accordingly, by including an array of holes 102*d*, the position of the riders toe relative to the edge of the snowboard can be adjusted without detaching baseplate 101. Similarly, when puck 102 includes arrays of holes 102*d*, baseplate 101 can be configured with a single arched slot 201*c* at each end (or equally a single arched arrangement of holes 101*c*). By including a single arched slot 201*c* (or arched arrangement of holes 101*c*), the length of baseplate 101 can be shortened to thereby ensure that it does not overhang the edge of the snowboard.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description.

What is claimed:

1. An interface for enabling a splitboard binding to be mounted to a snowboard comprising:

a baseplate having an opening;

a disc configured to insert into the opening in the baseplate, the disc including holes by which the disc can be mounted to a snowboard via a binding hole pattern of the snowboard, the disc being configured to secure the baseplate to the snowboard when the disc is mounted to the snowboard; and a puck that is configured to mount to the baseplate, the puck being configured to receive and secure a splitboard binding, the puck including opposing ledges by which the splitboard binding is secured.

2. The interface of claim 1, wherein the opening of the baseplate and the disc are circular.

3. The interface of claim 1, wherein the opening of the baseplate includes an inward facing surface.

4. The interface of claim 3, wherein the disc includes an outward facing surface that aligns with the inward facing surface when the disc is inserted into the opening.

5. The interface of claim 4, wherein the inward facing surface includes notches that interface with notches in the outward facing surface to prevent the disc from rotating relative to the baseplate.

6. The interface of claim 1, wherein the puck includes arrays of holes to enable the puck to be mounted to the baseplate in multiple positions.

7. The interface of claim 1, wherein the opposing ledges are oriented towards the baseplate and extend lengthwise along the puck.

8. The interface of claim 1, wherein the baseplate includes at least one arched opening at opposing ends.

9. The interface of claim 8, wherein each of the at least one arched opening comprises an arched arrangement of holes.

10. The interface of claim 8, wherein the at least one arched opening at opposing ends comprises a plurality of arched openings at opposing ends.

11. An interface for enabling a splitboard binding to be mounted to a snowboard comprising:

a baseplate having an opening;

a disc configured to insert into the opening in the baseplate, the disc including holes by which the disc can be mounted to a snowboard via a binding hole pattern of the snowboard, the disc being configured to secure the baseplate to the snowboard when the disc is mounted to the snowboard; and a puck that is configured to mount to the baseplate, the puck being configured to receive and secure a splitboard binding;

wherein the baseplate includes a plurality of holes positioned around the opening, the puck being configured to mount to the baseplate via the plurality of holes;

wherein the puck includes arrays of holes to enable the puck to be mounted to the baseplate in multiple positions.

12. The interface of claim 11, wherein the plurality of holes in the baseplate form a 3.5 inch by 1 inch pattern.

13. An interface for enabling a splitboard binding to be mounted to a snowboard comprising:

a baseplate having an opening;

a disc configured to insert into the opening in the baseplate, the disc including holes by which the disc can be mounted to a snowboard via a binding hole pattern of the snowboard, the disc being configured to secure the baseplate to the snowboard when the disc is mounted to the snowboard; and a puck that is configured to mount to the baseplate, the puck being configured to receive and secure a splitboard binding;

wherein the disc comprises a plurality of discs each of which includes holes that are arranged in a different pattern.

14. The interface of claim 13, wherein the plurality of discs includes a first disc with a 3×3 hole pattern and a second disc with a different hole pattern.

15. An interface for enabling a splitboard binding to be mounted to a snowboard comprising:

a baseplate having an opening;

a disc configured to insert into the opening in the baseplate, the disc including holes by which the disc can be mounted to a snowboard via a binding hole pattern of the snowboard, the disc being configured to secure the baseplate to the snowboard when the disc is mounted to the snowboard; and a puck that is configured to mount to the baseplate, the puck being configured to receive and secure a splitboard binding;

wherein the baseplate includes at least one arched slot at opposing ends.

16. An interface for enabling a splitboard binding to be mounted to a snowboard comprising:

a baseplate having an opening, the opening including a notched inward facing surface;

a disc having a notched outward facing surface that interfaces with the notched inward facing surface, the disc including holes by which the disc can be mounted to a snowboard via a binding hole pattern of the snowboard; and a puck that is configured to mount to the baseplate, the puck being configured to receive and secure a splitboard binding, the puck including opposing ledges by which the splitboard binding is secured.

17. The interface of claim 16, wherein the puck includes arrays of holes to enable the puck to be mounted to the baseplate in multiple positions.

18. The interface of claim 16, wherein the baseplate includes at least one arched opening at opposing ends.

19. An interface for enabling a splitboard binding to be mounted to a snowboard comprising:

a baseplate having an opening, the opening including an inward facing surface;

a disc having an outward facing surface that interfaces with the inward facing surface to secure the baseplate to a snowboard when the disc is secured to the snowboard; and a puck that is configured to mount to the baseplate, the puck being configured to receive and secure a splitboard binding, the puck including opposing ledges by which the splitboard binding is secured.

20. The interface of claim 19, wherein the puck includes arrays of holes to enable the puck to be mounted to the baseplate in multiple positions.

* * * * *